United States Patent [19]

Hibbel et al.

[11] Patent Number: 4,541,840

[45] Date of Patent: Sep. 17, 1985

[54] PROCESS AND DEVICE FOR THE DISCHARGE OF ASH-CONTAINING FUEL RESIDUES

[75] Inventors: Josef Hibbel; Ulrich Gerhardus; Volkmar Schmidt, all of Oberhausen; Bernhard Lieder, Bottrop; Heinrich Scheve; Erwin Zerres, both of Oberhausen, all of Fed. Rep. of Germany

[73] Assignee: Ruhrchemie Aktiengesellschaft, Oberhausen, Fed. Rep. of Germany

[21] Appl. No.: 521,468

[22] Filed: Aug. 8, 1983

[30] Foreign Application Priority Data

Aug. 13, 1982 [DE] Fed. Rep. of Germany ..... 3230088

[51] Int. Cl.[4] ..... C10J 3/00

[52] U.S. Cl. ..... 48/63; 48/69; 48/77; 48/197 R; 48/DIG. 2; 210/772; 210/774; 210/804; 210/806

[58] Field of Search ..... 210/772, 774, 769, 770, 210/802, 804–806, 521, 522; 48/197 R, 69, 63, 77, DIG. 2; 65/19; 110/266, 165 R, 171

[56] References Cited

U.S. PATENT DOCUMENTS

| | | | |
|---|---|---|---|
| 4,036,606 | 7/1977 | Zimmermann et al. | 48/77 |
| 4,342,638 | 8/1982 | Dahlstrom | 210/772 |
| 4,381,924 | 5/1983 | Schmidt et al. | 48/69 |
| 4,424,065 | 1/1984 | Langhoff et al. | 48/197 R |
| 4,425,139 | 1/1984 | Schmidt et al. | 48/77 |
| 4,459,134 | 7/1984 | Gates, Jr. et al. | 48/77 |

*Primary Examiner*—Benoit Castel

*Attorney, Agent, or Firm*—Sprung, Horn, Kramer & Woods

[57] ABSTRACT

The invention relates to a process and a device for the discharge of residues of ash-containing fuels occurring during gasification of coal. The hot mixture of residues and water is separated in a separating chamber, whereby the residues enter a lock vessel situated under the separating chamber. The hot water is recycled to the water bath situated under the gasification reactor. After the lock vessel has been filled with residue, the hot water in the separating chamber is cooled or replaced by cold water. The discharge of the residues is pressureless and is effected by a stream of water flowing through the separating chamber into the lock vessel. Separating chamber and lock vessel remain filled with water at all times.

12 Claims, 2 Drawing Figures

PROCESS AND DEVICE FOR THE DISCHARGE OF ASH-CONTAINING FUEL RESIDUES

BACKGROUND OF THE INVENTION

1. Field of the Invention

The invention relates to a process and a device for the discharge of residues occurring during the gasification of ash-containing fuels, in particular solid fuels such as bituminous coal, lignite and other carbonaceous substances with oxygen or oxygen-containing compounds such as water and/or carbon dioxide. The feedstock is converted at a pressure of 10 to 20 bar. The gasification residues leave the gasification chamber in liquid or plastic form and are turned into a solid granulate—which can also be finely grained—in a water bath which is connected to the gasification chamber. With the aid of a water-filled lock vessel which is located under the water bath, the granulate residues are periodically discharged from the pressure system of the pressurized gasification plant.

2. Discussion of Prior Art

A process and a device for the discharge of ash must fulfil a number of demands. Apart from the fact that the system should be economically viable to operate, it must be ensured that the residues are removed safely and without any detrimental effect on the environment. Thus the escape of product gas from the high-pressure gasification chamber into the atmosphere must be avoided at all costs owing to the danger of poisoning and explosion. Moreover, it must be ensured that dangerous and/or odorous gases, which for example are dissolved in the process water under pressure and released when the pressure is reduced, as wel as the polluted water, which is led off with the slag, are prevented from entering the environment. Finally, the flow of the granulated slag from the gasification chamber into the discharging system must only be interrupted by the discharging process for a short period to avoid slag building up in the gasification chamber and blocking the outlet.

In the DE-OS No. 28 29 629 corresponding to U. S. applicaton Ser. No. 280,029, now U.S. Pat. No. 4,425,139 assigned to the assignee hereof, the disclosure of which is hereby incorporated herein by reference, a process is described for the periodic discharge of residues occurring during the gasification of ash-containing fuels. The combustion residues occurring are granulated in a water bath in this process. Underneath the water bath a lock vessel is located which is connected to a separate water supply. It is connected to the water bath via a line in which an injector is installed. The injector sucks the water out of the lock vessel and returns it to the water bath. To compensate for this, water and slag enter the lock vessel from the water bath. The slag forms sediment in the lock vessel. Before the slag which has collected in the lock vessel is removed, the lock vessel which is under the same pressure as the water bath is depressurized into the separate water supply which is either pressureless or under slight excess pressure. Subsequently, a predetermined amount of water is flushed from the water supply into the lock vessel whereby the water and slag leave the lock vessel and enter a downstream collecting vessel which is either pressureless or under slight excess pressure. The water and slag are separated in the collecting vessel. After the connection between the lock vessel and the water bath has been shut off the lock vessel which is at all times completely filled with water, is brought to the same pressure as that of the water bath by the opening of a connecting line which leads to the water bath. The lock vessel is filled with slag by means of the water circuit previously described which is maintained by the injector.

The process described in the afore-mentioned publication can only operate trouble-free if the temperature in the water bath can be kept under 100° C. if possible or only slightly above the boiling point of the aqueous phase at atmospheric pressure. At temperatures above the boiling point of the aqueous phase at atmospheric pressure difficulties owing to spontaneous undesired vaporisation occur during the reduction of the pressure of the lock vessel to atmospheric pressure which must precede the pressureless emptying procedure. This vaporization prevents the desired rapid depressurization and stirs up liquid and already deposited ash which is carried off with the flash gas.

When coal with a high slag content is used where the slag enters the water bath in a hot state and/or when the slag mixture formed from the coal is partly or directly quenched, the water bath is automatically heated to temperatures far above the boiling point of the aqueous phase at atmospheric pressure depending on the operating pressure. This causes the difficulties which have already been described above. These disadvantages are eliminated by the present invention.

SUMMARY OF INVENTION

The invention comprises a process for the periodic discharge of residues occurring during gasification of ash-containing fuels, in particular solid fuels with oxygen and/or oxygen containing gasification agents at a pressure of 10 to 200 bar. The residues are granulated in a water bath and passed into a lock vessel which is continually filled with water and connected to a separate water supply container. After gasification pressure has been released to 0.05 to 4 bar or atmospheric pressure, the residues are flushed out of the lock vessel by the contents of the water supply container into a downstream collecting vessel. The process is characterized in that a separating chamber is located between the water bath and the lock vessel, when the lock vessel fills with slag a stream of water flows from the water bath into the separating chamber and is then returned from the separating chamber to the water bath whereby the water and the slag separate, the slag enters the lock vessel under the separating chamber, the separating chamber is connected to the separate water supply container and the hot water in the separating chamber is cooled or replaced by cold water after the lock vessel has been filled with slag and before discharge of the water slag mixture takes place.

The residues occurring during the gasification of ash-containing fuels, in particular solid fuels, form a granulate in the water bath. By means of a suitable valve arrangement the water slag mixture is led through a centrically located channel into a separating chamber which is completely filled with water and then returned from the separating chamber by a means of conveyance to the water bath as a hot water phase which is cleansed of solids. The upper section of the centric channel consists of a tube to which parallel guide fins are attached which have an opening in the middle which forms a channel. For practical purposes the fins are overlapping and have the form of a truncated cone or a tilted plate.

The opening which is determined by the total diameter is slanted upwards. Its diameter is 70 to 99% of that of the separating chamber. They are attached to supporting axes which are fitted with spacers so that a parallel arrangement of the individual guide fins is guaranteed. It has been proved advantageous to use a conical shape with an apex angle of 30° to 160°, preferably 60° to 120°. However, it is also possible to design fins as tilted plates. Another tube forms the lower section of the centric channel, the end of which only juts a small distance into the lock vessel which is immediately downstream of the separating chamber. The centric channel has the task of guiding falling solid particles into the lock vessel and leading hot water out of the separating chamber along its fins.

In the separating chamber the finely-divided slag, which has settled on the fins incorporated in the separating chamber, is separated from the water while the hot water is fed directly back into the water bath from the separating chamber.

The hot water enters the separating chamber through the centric channel and flows through the guide fins, here considerable deceleration of the flow resulting from an increased total cross-section and the short sediment paths between the plates cause the effective separation of even fine particles. The hot water is drawn off at the head of the separating chamber and returned to the water bath by a means of conveyance. Owing to its heavy weight, coarse compact slag sinks through the centric channel into the lock vessel located under the separating chamber and settles there. As the centric channel passes through the separating chamber but only juts a small amount into the lock vessel, there is no risk of hot and thus lighter circulated water entering the lock vessel. On the contrary the hot water flows between the parallel fins before it reaches the end of the centric channel and is returned to the water bath by a means of conveyance.

The finely particled ash or finely grained slag particles settle on the fins, agglomerate in the course of time into a more compact layer which owing to its own weight finally slips down the incline of the fins into the centric channel and subsequently into the lock vessel. Thus a possible heating as a result of the hot water from the water bath mixing with the cold water from the lock vessel is prevented and at the same time a satisfactory separation of finely-divided slag and/or ash is achieved.

As soon as the lock vessel located directly underneath the separating chamber is filled with slag, i.e. both with the finely grained slag described above, which agglomerates on the fins in the separating chamber and slips down into the lock vessel, and with the coarsely grained compact slag, which sinks directly through the separating chamber in the centric channel down into the lock vessel, valves are closed to stop the flow of the water-slag mixture out of the water bath into the separating chamber. This also applies to the circulation driven by a means of conveyance in which a water-slag mixture is transported from the water bath to the separating chamber and a hot water phase free of slag circulates from the separating chamber to the water bath.

After the lock vessel has been filled with slag and ash, valves are opened and the hot water in the separating chamber is led by a means of conveyance through a heat exchanger and cooled until the temperature of the water in the separating chamber is less than 100° C. This measure prevents spontaneous vaporization occurring as a result of the high water temperature when the separating chamber and the lock vessel are subsequently slashed from a gasification pressure of 10 to 200 bar to a pressure of 0.05 to 4 bar or atmospheric pressure. With this method pressure is released very quickly via the pressure-release line without agitation or partial blowing out of the lock vessel contents.

An alternative method instead of using a heat exchanger for cooling purposes is to feed cold pressurized water directly into the separating chamber to force the hot water present in the separating chamber through the connecting line between the separating chamber and the water bath into the water bath and then to reduce the pressure of the cold contents now present in the separating chamber and the lock vessel.

A further reduction is achieved by the opening of a valve in a connecting line which connects the separating chamber with a pressureless collecting vessel downstream of the lock vessel. This collecting vessel always has a predetermined level of water in it and is connected to a gas network of moderate pressure or a suction unit. Depressurization is almost instantaneous as only an incompressible volume of water is released, the temperatures of which are below boiling point at atmospheric pressure.

The slag which has been collected in the lock vessel is removed by a predetermined amount of water from the water supply container located above the separating chamber and connected to the head of the separating chamber by a line. Within the separating chamber the water flows from between the fins into the centric channel of the separating chamber, thus enters the lock vessel and from there passes via a line through a previously opened valve to a collecting vessel downstream of the lock vessel. The water from the water container flushes out the slag which has collected in the lower section of the lock vessel and carries it as a water-slag mixture into the collecting vessel located downstream of the lock vessel. There the slag forms sediment and is subsequently separated from the water e.g. by means of a mechanical separator or a slag scraper.

Removal takes place within a short time and is normally completed within 15 to 25 seconds. Between 20 and 30 seconds are to be allowed for the entire process of pressure release, discharge and pressure compensation. The opening and closing sequence for the valves is automatic so no human error can occur.

The separating chamber and the lock vessel always remain filled with water even during the discharge step. This is due to the fact that the water supply container located above the separating chamber is never completely emptied but only a predetermined amount of water is removed from it. After discharge of the slag the connection between the separating chamber and the water supply container and that between the lock vessel and the collecting vessel are interrupted and pressure is automatically compensated by the opening of a valve in a connection between the water bath and the separating chamber. After pressure compensation this valve is reclosed and the line designed for the slag to flow through is opened between the water bath and the separating chamber. At the same time the line from the separating chamber via the means of conveyance to the water bath is opened, thus re-establishing the circulation and slag can be recollected in the lock vessel.

BRIEF DESCRIPTION OF DRAWINGS

Useful modes and process are shown in the accompanying drawings in which.

DESCRIPTION OF SPECIFIC EMBODIMENT

Figure 1:
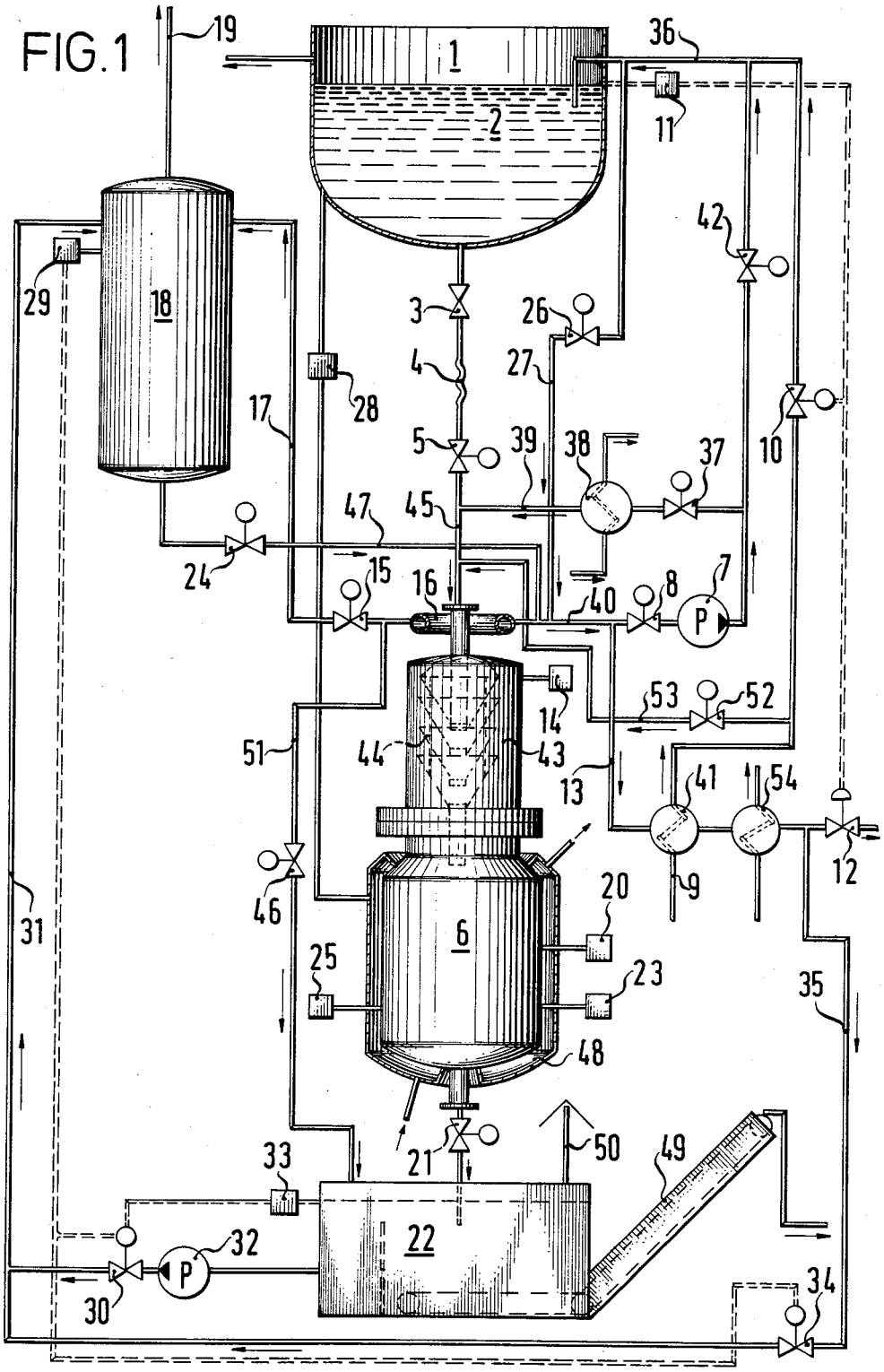
FIG. 1 is a schematic diagram showing the process and apparatus of the invention.

Referring to the drawings, the gasification residues formed in a gasification chamber (1) at pressures of 10 to 200 bar and at temperatures of 1100° to 1700° C. enter a water bath (2), cool down there, granulate and in the form of an aqueous suspension pass through an opened safety valve (3), a flexible connection (4), e.g. a compensator, an opened valve (5) into a separating chamer (43), which is connected with a lock vessel (6) and is under the same high pressure as the gasification chamber. The separating chamber (43) is equipped with a level gauge (14). The lock vessel (6) has two level gauges (23) and (25) and a pressure gauge (20) and is provided with a cooling jacket (48).

The water bath (2) has a high temperature of e.g. 200° C. depending on the partial presure of the water vapor in the synthesis gas. In order to prevent the concentration of dissolved salts and finely grained solid particles originating from the gasification residues from reaching inadmissible levels in the water, an amount of circulated process water or fresh water which can be regulated by means of a valve (10), is fed in through line (9). A level control device (11) keeps the level of water constant by means of a valve (12) in an outlet line (13) in which a cooler (41) and a further cooler (54) are located. Granulated residues with a bad sedimentation behavior are extracted from the water bath (2) into the separating chamber (43) with the aid of a means of conveyance (7), e.g. a pump, which is connected to the separating chamber via a line (40), (16) and a valve (8). The hot water is separated from the slag in the separating chamber. The water which is led off from the separating chamber is returned to the water bath via a line (36) together with the circulated process water.

The separating chamber (43) comprises a centric feed channel (45), the upper section of which is a tube and the lower section (44) of which is formed by conical shaped parallel plates which have a centric opening on the downward slanting fins. The last of these conical plates is extended in the middle to form a throat which protrudes into the lock vessel (6). As a result of the suction effect of the pump (7) the water-slag mixture enters the separating chamber (43) via the centrically located feed channel (45). The speed of the water-slag mixture is higher in the feed channel than between the plate surfaces which are parallel and slanting upwards (44). Between these plate surfaces (44) the mixture does not flow so fast and the solid particles form sediment. Coarser slag particles sink during this filling process through the feed channel directly into the lock vesseel (6) located under the separating chamber (43).

As both the separating chamber (43) and the connected lock vessel (6) are continually filled with water, there is no mixing of the cold contents of the lock vessel (6) with the hot water-slag mixture entering the separating chamber (43). On the contrary the hot water in the separating chamber is guided over the conical-shaped plates and returned via the head through the closed circuit line (16) which opens into a line (40) via valve (8), a means of conveyance (7), valve (42) and line (36) into the water bath (2). After the lock vessel (6) has been filled with slag, the valve (10) and the valve (12) are simultaneously closed. The water feed via line (9) and the water outlet via line (13) are therefore interruped. The connection between the water bath and the separating chamber is interrupted by the closing of valve (5) and the return of the water from the separating chamber into the water bath by the closing of valve (42). By the opening of valve (37) the hot water located in the separating chamber is cooled by means of a cooling system (38) located in a line (39) which connects the suction line (40) of the means of conveyance (7) via line (45), the separating chamber (43) and the closed circuit line (16). After the hot water has been cooled the pressure can be released.

One can perform the process using the hot water located in the separating chamber and under pressure and expelling the same by the feeding of cold water. For this purpose, cold water is led into the separating chamber from line (9) via a line (53) which connects line (9) with the feed channel (45) via a valve (52) and the hot water located in the separating chamber is passed off via the closed circuit line (16), line (13), cooler (41) and valve (12), which is opened a small amount. The valves (8) and (37) are closed. After the hot water has been expelled and the valve (12) has been closed, the pressure can be released from the separating chamber (43) and the lock vessel (6).

Another possibility is to expel the hot water located in the separating chamber and under pressure into the water bath by the feeding of cold water. The water is fed in as described above via line (9), line (53), valve (52) and feed channel (45). The hot water which is to be expelled leaves the separating chamber (43) via the closed circuit line (16), line (40), valve (8), which is opened, pump (7), valve (42), which is opened, and the line (36) into the water bath. After the hot contents of the separating chamber have been expelled the valves (52) and (8) are closed. After this, pressure in the separating chamber (43) and the lock vessel (6) can be released.

The pressure in the separating chamber (43) and the lock vessel (6) is released via the closed circuit line (16) into a line (17), which by opening of valve (15) and the simultaneous closing of valves (8) and (37) connects the separating chamber with the water supply container (18), which is under a pressure of 0.05 to 4 bar and connected to a waste gas network (19). During this procedure gaseous components such as CO and $H_2$ dissolved in water escape. As, for the main part, an enclosed volume of liquid is depressurized, the reduction in pressure takes place automatically. Valve (15) is subsequently closed. The reduction of pressure to atmospheric pressure takes place via a line (51), which is also connected to the closed circuit line (16), by the opening of a valve (46) into a collecting vessel (22), which is equipped with a mechanical separating device (49) to separate the slag from the water and which is under atmospheric pressure. The remaining quantities of gas which are released during this depressurization process are taken up in the collecting vessel (22) via a line (50) and e.g. burned.

The separating chamber and the lock vessel connected to it are emptied by the opening of valve (24), which is located in a connecting line (47) between the water supply container (18) and line (40), and by the opening of valve (21) which is installed in the connecting line between the lock vessel (6) and the collecting vessel (22). Water flows from the water supply container (18) via the closed circuit line into the separating chamber (43) and flushes the slag deposited between the individual conical plates arranged in a parallel configuration into the centric feed channel and from there into lock vessel (6). The water-slag mixture passes via the previously opened valve (21) into the collecting vessel (22) where water and slag are separated for example by means of a mechanical device such as a slag conveyor (49).

Water from the collecting vessel (22) enters the water supply container (18) via a pump (32) and a valve (30) controlled by a level gauge (33) and a line (31). Water lost during separation of water and slag in the collecting vessel (22) is replaced via line (31) with the aid of a level gauge (29) located on the water supply container (18), the level gauge opening a valve (34) situated in a line (35). In this way the predetermined level of the water in the water supply container (18) is maintained.

Before the water supply container (18) is drained, the valves (21), (46) and (24) are closed. The lock vessel (6) and the separating chamber (43) are therefore always filled with water. The lock vessel (6) can then be refilled with slag.

The pressure between the water bath (2) and the lock vessel (6) is compensated by the opening of valve (26) in a line (27) which connects lines (40) and (36) with each other. A differential pressure control gauge (28) indicates pressure compensation. As the connecting lines (45), (40) and (9) and the separating chamber are all filled with water, pressure compensation between the water bath (2) and the separating chamber (43) takes place instantaneously via the incompressible medium water. The original connection between the water bath and the separating chamber is re:established by closing valves (26) and (37) and opening valves (5), (8) and (42) and the separating chamber is refilled with slag from the water bath (2). The level control (11) via valves (10) and (12) is turned on again.

Figure 2:
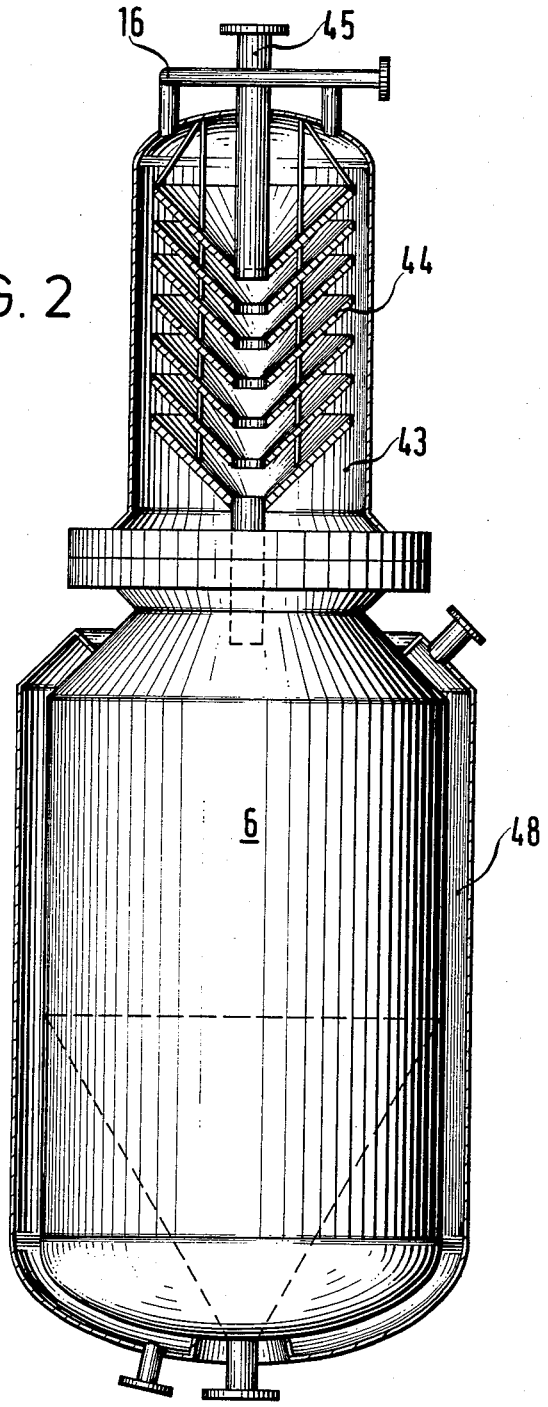
FIG. 2 is an enlarged detail of the separation chamber used according to the invention.

An enlarged diagram of the separating chamber and the lock vessel is given in FIG. 2 to aid comprehension of the procedure. The numbers employed are the same used to describe the elements in the device according to the invention.

What is claimed is:

1. In a process for periodically discharging slag containing residue occuring during gasification of ash-containing solid fuels with oxygen and/or an oxygen containing gasification agent at a pressure of 10–200 bar wherein said residue is collected in a water bath (2), passed to a lock vessel (6) which is continually filled with water from a water supply container (18) with which it is in fluid communication and following gasification and pressure reduction to 0.05 to 4 bar pressure the residue is flushed out of said lock vessel (6) by water from said water supply container (18) into a downstream collecting vessel (22), comprising passing said residue in admixture with water from said water bath initially to a separating chamber (43) disposed upstream of said lock vessel (6), said separating chamber being in fluid communication with said water bath and said lock vessel, separating said slag from said water in said separating chamber (43) and returning water separated in said separating chamber (43) to said water bath, passing said slag from said separating chamber to said lock vessel, said lock vessel (6) being connected to said water supply container (18) via said separating chamber (43) and after said lock vessel is fed with slag but before its contents are flushed into said downstream collecting vessel (22) replacing water at an elevated temperature in said separating chamber with water at a lower temperature.

2. A process according to claim 1 wherein water flowing from said water bath (2) into said separating chamber (43) is passed through a centrically located channel (45) which leads through said separating chamber (43), said channel comprising an upper, a middle and a lower section, said middle and lower sections comprising parallel guide fins and water is returned to said water bath from said separating chamber via a ring reactor means after solids therein have sedimented in said separating chamber.

3. A process according to claim 1 wherein during discharge of the contents of said separating chamber and lock vessel, water from said water supply container is passed via a ring reactor in fluid communication with said separating chamber into said separating chamber and caused to flow through parallel fins (44) disposed within said separating chamber upon which solids have sedimented and to enter lock vessel (6) via a central channel (45) connecting said separating chamber and said lock vessel (6).

4. A process according to claim 1 wherein water in said separating chamber is fed to a cooling device by a conveying means and returned to said separating chamber whereby to replenish water at an elevated temperature with cooler water.

5. A process according to claim 1 wherein water at an elevated temperature is withdrawn from said separating chamber and fresh water at a lower temperature is fed to said separating chamber.

6. A process according to claim 5 wherein said water at an elevated temperature is introduced into said water bath.

7. A process according to claim 5 wherein said water at an elevated temperature is cooled and introduced into said water bath.

8. An apparatus for discharging slag containing residue occuring during gasification of an ash containing solid fuel with oxygen or an oxygen containing gas comprising a solid fuel gasifier, means for feeding oxygen or an oxygen containing gas to said gasifier, a water bath in said gasifier for receiving solid or liquid slag, said water bath in fluid communication via a first valved line with a separating chamber having means therein for separating solids from water, said separating chamber in fluid communication with a lock vessel which in turn is in fluid communication with a collecting vessel via a second valved line, which collecting vessel is connected to a reduced-pressure gas network, said separating chamber being in fluid communication additionally via a ring header through which passes water separated in said separating chamber, said ring header being in the form of a closed circuit pipeline and connected via a third valved line to a conveying means disposed between a first valve and a second valve in said third valved line to said water bath, said third valved line branched by a line between said conveying means and the valve downstream thereof by a fourth valved line having a cooling means therein which interconnects with said first valved line, said ring header in fluid communication with a water supply container via a line which intersects said third valved line, said apparatus further comprising means for separating water and slag obtained in said collecting vessel and means for returning water so-separated to said water supply container via a return line.

9. An apparatus according to claim 8 wherein said separating chamber comprises a conical arrangement of parallel guide fins which have an apex angle of 30° to 160° and the cross section thereof continuously increases towards the outer edge.

10. An apparatus according to claim 9 wherein said fins are in the form of slanted plates.

11. An apparatus according to claim 9 wherein said ring header is in fluid communication with a source of flush water via a fifth valved line.

12. An apparatus according to claim 9 further comprising means for adding fresh water to said separating chamber.

* * * * *